US011345502B2

(12) United States Patent
Chavel et al.

(10) Patent No.: US 11,345,502 B2
(45) Date of Patent: May 31, 2022

(54) SYSTEM FOR DISCHARGING PRODUCT FROM A BAG

(71) Applicant: Tetra Laval Holdings & Finance S.A., Pully (CH)

(72) Inventors: Thomas Chavel, Cholet (FR); Christophe Puyjalon, Begrolles en Mauges (FR); Yann Kerleroux, La Guyonnière (FR)

(73) Assignee: Tetra Laval Holdings & Finance S.A., Pully (CH)

( * ) Notice: Subject to any disclaimer, the term of this patent is extended or adjusted under 35 U.S.C. 154(b) by 318 days.

(21) Appl. No.: 16/607,088

(22) PCT Filed: Apr. 27, 2018

(86) PCT No.: PCT/EP2018/060910
§ 371 (c)(1),
(2) Date: Oct. 21, 2019

(87) PCT Pub. No.: WO2018/202581
PCT Pub. Date: Nov. 8, 2018

(65) Prior Publication Data

US 2020/0377251 A1 Dec. 3, 2020

(30) Foreign Application Priority Data

May 4, 2017 (EP) ..... 17169564

(51) Int. Cl.
*B65B 69/00* (2006.01)
*B65B 37/02* (2006.01)
(Continued)

(52) U.S. Cl.
CPC ..... *B65B 69/0091* (2013.01); *B65B 37/02* (2013.01); *B65B 37/04* (2013.01); *B65B 39/02* (2013.01); *B65B 57/005* (2013.01)

(58) Field of Classification Search
CPC ..... B65B 69/0091; B65B 37/02; B65B 37/04; B65B 39/02; B65B 57/005
See application file for complete search history.

(56) References Cited

U.S. PATENT DOCUMENTS 4,998,991 A * 3/1991 Poulton ..... B65B 69/0091 222/181.3
5,320,251 A * 6/1994 Ellis ..... B65D 88/16 222/105

(Continued)

FOREIGN PATENT DOCUMENTS

DE 10013838 A1 10/2001
DE 10025595 A1 12/2001
EP 0785151 A1 7/1997

OTHER PUBLICATIONS

International Search Report for corresponding Application No. PCT/EP2018/060910, dated Jun. 8, 2018.

(Continued)

*Primary Examiner* — Timothy L Maust
(74) *Attorney, Agent, or Firm* — Renner, Otto, Boisselle & Sklar, LLP

(57) ABSTRACT

A system for discharging product from a bag, the system including: a vibration unit arranged to support the bag and to vibrate so that the product exits an opening of the bag; a conduit having an inlet that is located below the vibration unit to receive the product; a downstream equipment connected to the conduit to receive the product from the conduit; wherein a protective cage is arranged around the inlet of the conduit, the protective cage having an open position to allow access to the inlet, and a closed position to restrict access to the inlet.

13 Claims, 3 Drawing Sheets

(51) Int. Cl.

| | |
|---|---|
| ***B65B 37/04*** | (2006.01) |
| ***B65B 39/02*** | (2006.01) |
| ***B65B 57/00*** | (2006.01) |

(56) References Cited

U.S. PATENT DOCUMENTS

| | | | | |
|---|---|---|---|---|
| 5,944,070 | A * | 8/1999 | Schmidt | B65B 69/0091 141/114 |
| 5,944,470 | A * | 8/1999 | Bonerb | B65B 69/0091 414/421 |
| 6,450,754 | B1 * | 9/2002 | Catton | B65B 37/04 222/185.1 |
| 7,223,058 | B2 * | 5/2007 | Nyhof | B65B 69/0091 414/415 |
| 8,499,972 | B1 * | 8/2013 | Landry | B65B 69/0075 222/105 |
| 9,810,363 | B2 * | 11/2017 | Ganzer | F16K 3/0281 |
| 2001/0027822 | A1 * | 10/2001 | Bertolo | B65B 69/0075 141/66 |
| 2001/0038018 | A1 * | 11/2001 | Bell | G01G 13/16 222/58 |
| 2005/0199650 | A1 * | 9/2005 | Nyhof | B66C 1/226 222/105 |

OTHER PUBLICATIONS

Extended European Search Report for corresponding Application No. EP17169564.6, dated Oct. 25, 2017.

* cited by examiner

SYSTEM FOR DISCHARGING PRODUCT FROM A BAG

TECHNICAL FIELD

The invention relates to systems for discharging products from big bags.

BACKGROUND ART

Today big bag discharging systems are specifically designed for discharging a large variety of products from different types of big bags. A "big bag" is in this context a bag capable of holding a content with a weight of at least 300 kg. Commonly the weight of a big bag and its content is with a range of 500-1500 kg, but even bigger (heavier) bags may be handled. Examples of products that are held in big bags are food products and ingredients like rice, flour, cereals, whey, peas, beans and other form of food products in powdery or granular form. Other products may be handled as well, such as pharmaceutical products as well as any other product or substance that can be held and emptied from a big bag. Generally, the products inside the big bag have the form of small particles, including powder.

Big bag discharging systems are specifically designed for handling the heavy weight of the big bags while eliminating dust emissions, product loss or product contamination. It is important that big bags can be safely emptied by the systems, without risking that any operator is injured. Most prior art big bag discharging systems used today include safety systems that greatly reduce the risk that any operator is injured when working with the system. However, it is still believed that safety mechanisms may be improved for big bag discharge systems, in particular when the discharge system includes downstream equipment that receives the product and which equipment may cause harm to an operator, unless protective measures are taken.

SUMMARY

It is an object of the invention to at least partly overcome one or more of the above-identified limitations of the prior art. In particular, it is an object to provide a system that can be safely and efficiently operated to discharge product from a bag.

To solve these objects a system for discharging product from a bag is provided. This system comprises: a vibration unit arranged to support the bag and to vibrate so that the product exits an opening of the bag; a conduit having an inlet that is located below the vibration unit to receive the product; a downstream equipment connected to the conduit to receive the product from the conduit; and a protective cage that is arranged around the inlet of the conduit, the protective cage having an open position to allow access to the inlet, and a closed position to restrict access to the inlet.

The bag may be a big bag, i.e. a bag that when filled holds product with a weight of at least 300 kg. Thus, the system may be referred to a system for discharging product from a big bag.

The system is advantageous in that it may efficiently prevent e.g. an operator from entering a hand or arm into the conduit when the system is operated. This also prevents the operator from coming into contact with the parts of the downstream equipment that receives the product, which is beneficial since the downstream equipment often includes movable parts that are potentially dangerous to touch. While still protecting an operator efficiently by restricting the access, the product can easily flow into the conduit during operation. Moreover, the system and in particular the conduit may be efficiently cleaned by allowing access when the system is stopped.

According to another aspect a method of operating the system for discharging product is provided. In this method no protective grid is arranged around the system when the system is operated to discharge the product. In this context, a grid may be a fence or some other protective barrier that is arranged around the system to prevent access.

Still other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which.

DETAILED DESCRIPTION

Figure 1:
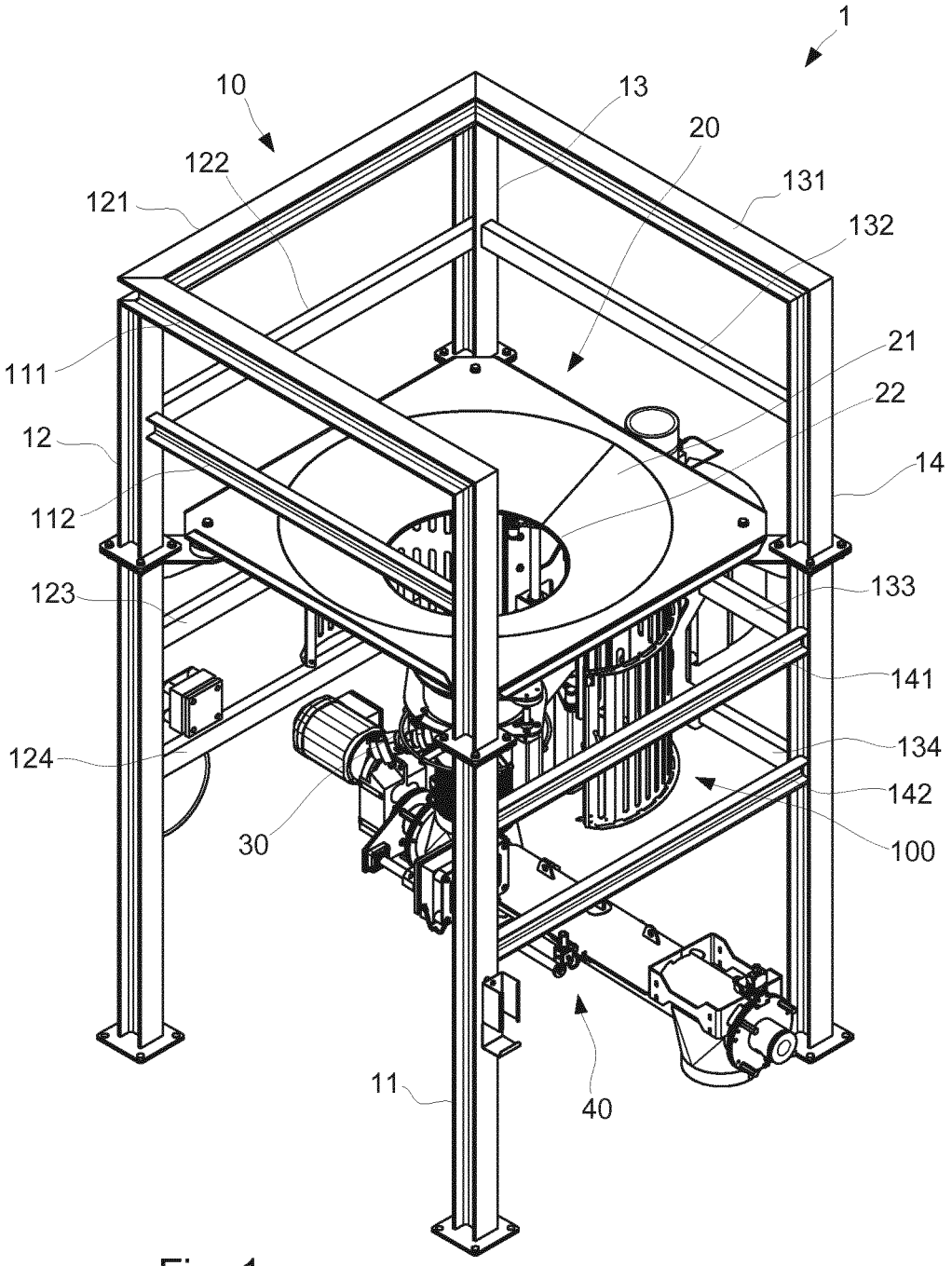
FIG. 1 is a perspective view of a system for discharging product from a bag, when a protective cage is an open position
Figure 3:
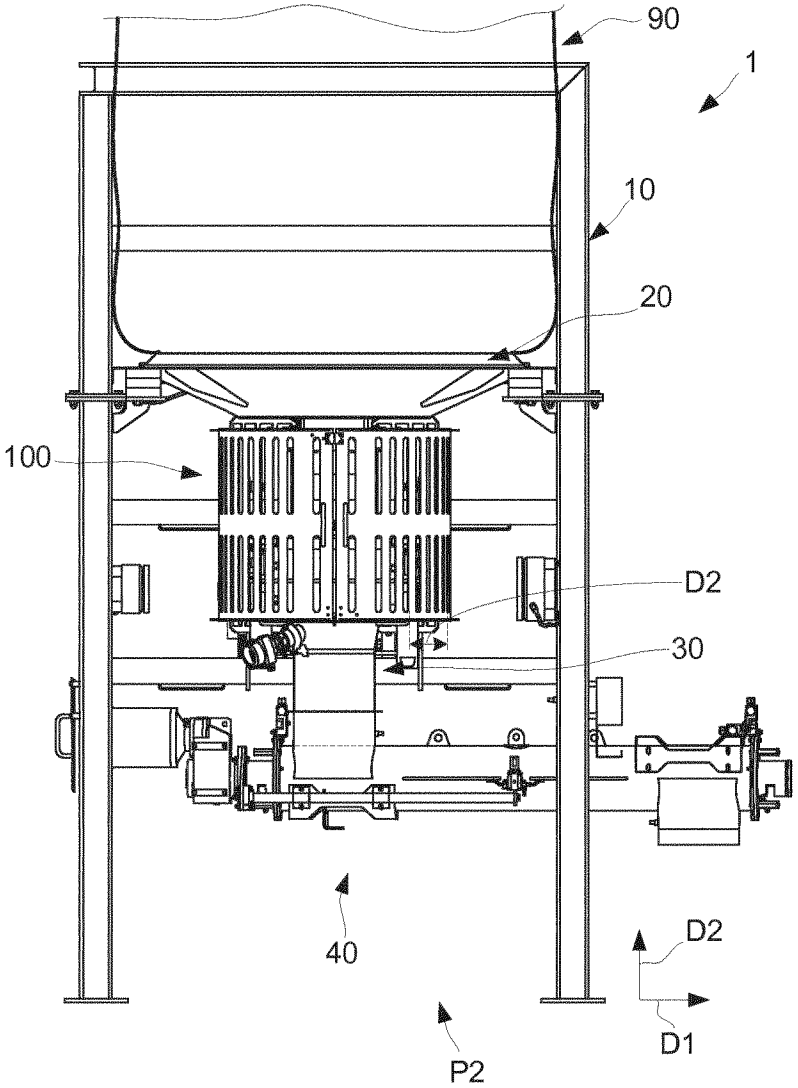
FIG. 3 is a front view of the system of FIG. 2, when the protective cage is in a closed position.
Figure 2:
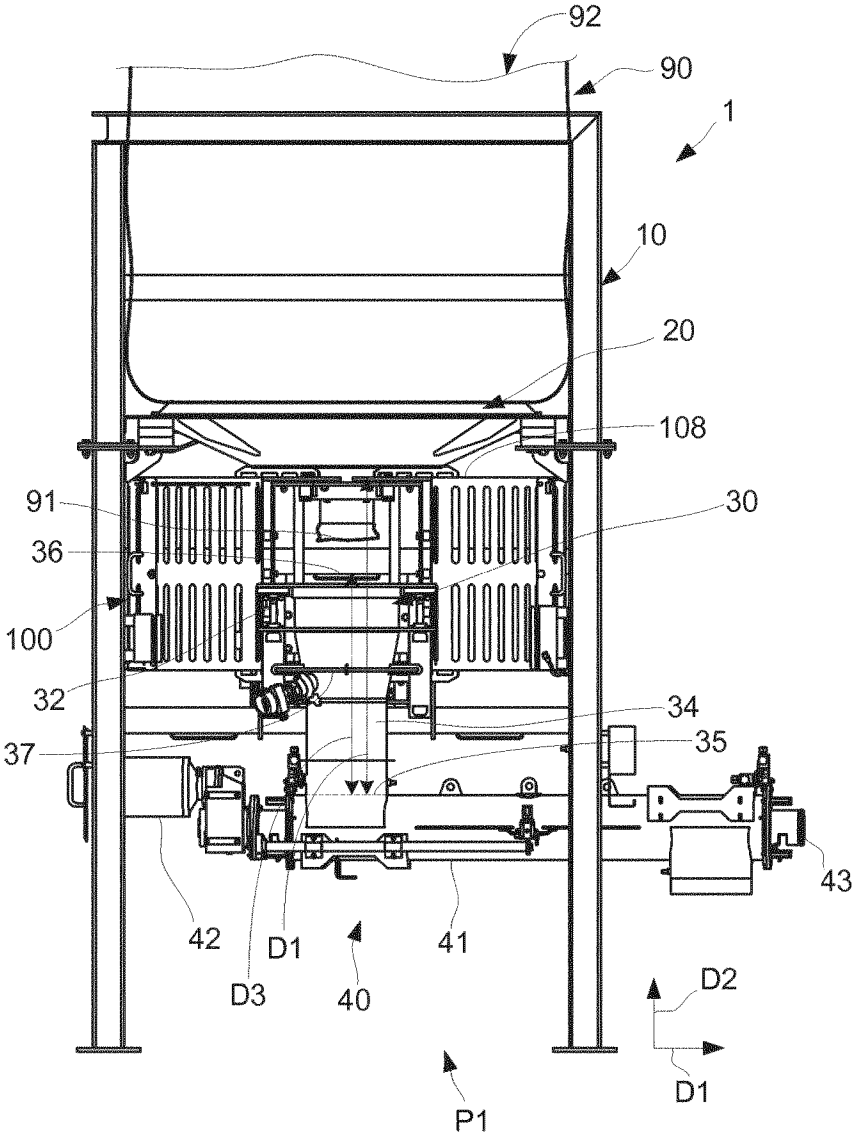
FIG. 2 is a front view of the system of FIG. 1, when the protective cage is in the open position.

With reference to FIGS. 1, 2 and 3 a system 1 for discharging product 92 from a bag 90 is illustrated. The product 92 has granular form or powder form, and is typically a dry product. The bag 90 may be a big bag in the sense that it is capable of holding product with a weight of at least 300 kg, or capable of holding product with a weight within the range of 500-1500 kg, Thus, the system 1 may be a system 1 that is arranged to discharge product 92 from a bag 90 that holds product with a weight of at least 300 kg, or holds product with a weight within the range of 500-1500 kg.

The system 1 has a vibration unit 20 that is arranged to support the bag 90. The vibration unit 20 may have the form of a hopper or a table that is capable of vibrating. The vibration unit 20 is arranged to vibrate so that the product 92 exits an opening 91 of the bag 90. The vibration unit 20 has a hole 22 through which the bag opening 91 may extend, and a surface 21 that is slanted downwards towards the hole 22. Herein, terms like "down", "up", "below", "above", "lower", "upper" and similar refer to directions and positions in relation to a vertical direction D2. The vertical direction D2 is perpendicular to a horizontal direction D1.

A conduit 30 that has an inlet 36 is located below the vibration unit 20 to receive the product 92. In the illustrated figures the opening 91 of the bag 90 is not connected to the conduit 30. To accomplish a connection the conduit 30 is moved up towards the bag opening 91 and the bag opening 91 is clamped to the conduit 30 by a connector 32. The conduit 30 has a flexible element 34 that is expandable and contractible in the vertical direction D2, so that the conduit 30 may be moved up towards the bag opening 91 to accomplish the connection, respectively to move away from the bag opening 91 when the connection shall be released.

A downstream equipment 40 is connected to the conduit 30 to receive the product 92 from the conduit 30. The downstream equipment 40 is typically rigidly connected to the conduit 30. Examples of downstream equipment 40 include conveyer screws, rotary valves, butterfly valves and lump breakers. The downstream equipment 40 generally has at least one moving part and it would be dangerous if one puts an arm into the conduit 30, so that the downstream equipment 40 is reached.

In the illustrated example the downstream equipment 40 is a conveyer screw, which has a tube 41 in which a screw is arranged to rotate when driven by a motor unit 42, so that product may exit from a conveyer opening 43.

The vibration unit 20, the conduit 30 and the downstream equipment 40 may be implemented and operated according to known techniques and principles, An example of a system for discharging product from a bag that includes a suitable vibration unit and a suitable conduit, and which may operate with different downstream equipment, is the system sold by Tetra Pak® under the name Tetra Pak® Big Bag Tipping unit VB005.

The system 1 has a frame structure 10 that supports the vibration unit 20 and the conduit 30. The frame structure 10 comprises four legs 11, 12, 13, 14 that are arranged to form a rectangular box. The first and second legs 11, 12 are connected to each other by a first upper support bar 111 and a second upper support bar 112 that is located below the first support bar 111. Each of the support bars 111, 112 are located above the vibration unit 20. Preferably, no bars are connected between the first leg 11 and second leg 12 at a height under the vibration unit 20, which facilitates access to the conduit 30 from a position between the first leg 11 and the second leg 12.

The second and third legs 12, 13 are connected to each other by two upper support bars 121, 122 which both are located above the vibration unit 20. The third and fourth legs 13, 14 are also connected to each by two upper support bars 131, 132 which both are located above the vibration unit vibration unit 20.

Three pairs of support bars 123, 124, 133, 134 and 141, 142 connect the second leg 12 to the third leg 13, the third leg 13 to the fourth leg 14 respectively the fourth leg 14 to the first leg 11. These support bars 123, 124, 133, 134 141, 142 are located below the vibration unit 20. Between two of the legs, in this example between the fourth and the first legs 14, 11, there is no support bar above the vibration unit 20, to facilitate lifting the bag 90 onto the vibration unit 20. Any of the support bars between the legs may be referred to as a transversal support bar.

A protective cage 100 is arranged around the inlet 36 of the conduit 30. The protective cage 100 can be opened, i.e. it has an open position P1, to allow access to the inlet 36. The protective cage 100 can also be closed, i.e. it has a closed position P2, to restrict access to the inlet 36.

The protective cage 100 is attached to the frame structure 10. Preferably, the protective cage 100 is attached to the frame structure 10 at a position that is opposite a side of the frame structure 10 where no support bars are connected between the legs at a height that is under the vibration unit 20. In the illustrated example the protective cage 100 is attached to the support bar 133 that extends between the third leg 13 and the fourth leg 14. Alternatively, the protective cage 100 is attached to the conduit 30 or to the vibration unit 20.

Figure 4:
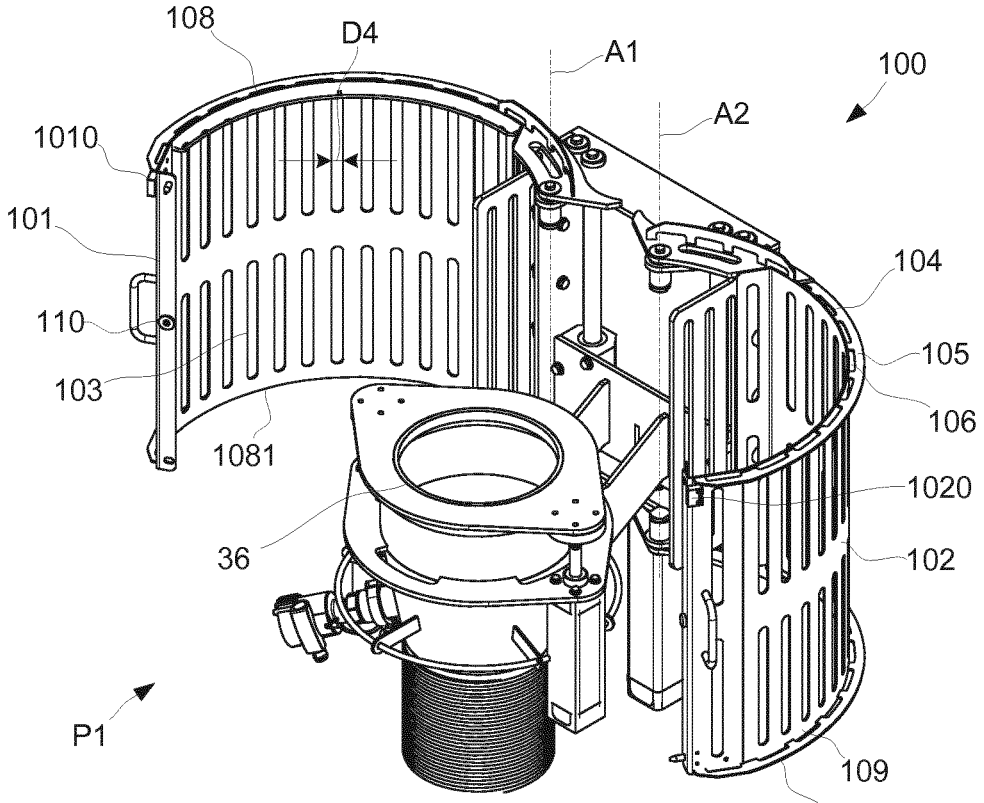
FIG. 4 is a perspective view of a protective cage in an open position.
Figure 5:
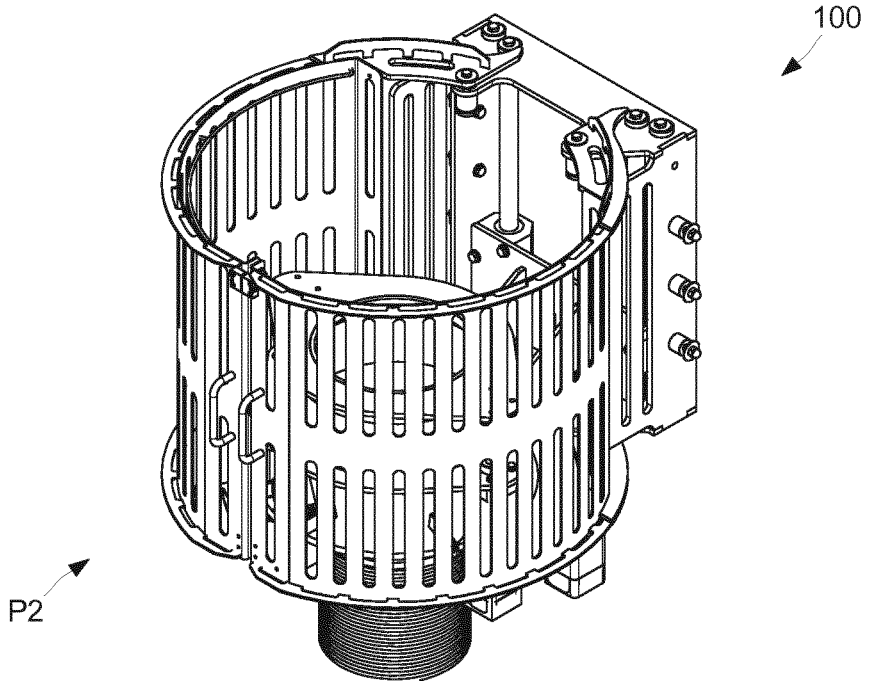
FIG. 5 is a perspective view of a protective cage in a closed position.

With further reference to FIGS. 4 and 5, the protective cage 100 has two doors 101, 102 that are pivotable about a respective axis A1, A2 and in a direction away from each other. When the doors 101, 102 are pivoted away from each other they are "swung open", so that the protective cage 100 is in the position P1 that allows access to the inlet 36. When the doors 101, 102 are pivoted towards each other so that they abut each other at their fronts they are "swing shut", so that the protective cage 100 is in its closed P2 that prevents access to the inlet 36. To keep the doors 101, 102 closed magnets 110 that attract each other may be arranged on the doors 101, 102 at a location on the doors where the doors abut when they are pivoted towards each other.

The protective cage 100 is confined within the frame structure 10 when the protective cage 100 is in the closed position P2. This means that the doors of the protective cage 100 fit inside a geometrical box that is defined by the outer boundaries of the frame structure 10. The same applies when the protective cage 100 is in the open position P1, i.e, when the doors 101, 102 are pivoted away from each other they fit within a geometrical box that is defined by the outer boundaries of the frame structure 10. The frame structure 10 limits, due to the support bars 123, 141 that are located between the second leg 12 and the third leg 13 respectively the fourth leg 14 and the first leg 11, the pivotation of the two doors 101, 102. Thus, the first door 101 is arranged to hit a support bar between two legs of the frame structure 10 when opened as much as possible, and the second door 102 is arranged to hit another support bar between two other legs of the frame structure 10 when opened as much as possible. The support bars 123, 141 that limit the pivotation of the doors 101, 102 are arranged opposite each other on the frame structure 10.

The protective cage 100 does not extend below any part of the flexible element 34 of the conduit 30. This applies both when the conduit 30 is in its uppermost position when it is connected to the bag 90, as well as when it is in its lowermost position when the conduit 30 is unconnected to the bag 90. The protective cage 100 typically extends, as seen in the vertical direction D2, from the vibration unit 20 to a position above the flexible element 34.

As may be seen from FIGS. 4 and 5, a number of elongated slots 103 are arranged in the doors 101, 102, which allow the conduit 30 to be visible through the doors 101, 102. A width D4 of the slots 103 is smaller than 21 mm. Herein, a width is the smallest possible distance that may be measured between two opposite sides of the slot 103. None of the doors 101, 102 should have an opening (through hole) with a width that is larger than 21 mm. Here, a width is the smallest possible distance that may be measured between two opposite sides of any opening in the doors. For example, the width of a rectangular opening is the shortest distance between the two longs sides of the opening, the width of a circle is the diameter of the circle, and the width of an ellipse is twice the distance of the semi-minor axis of the ellipse.

The protective cage 100 has an upper reinforcement rib 105 that extends along an upper section 104 of the protective cage 100. The reinforcement rib 105 protrudes from the upper section 104, in the horizontal direction D1, and has a number of through holes 106 that extend along the upper section 104. The reinforcement rib 105 may comprise one section that extends along the upper side of the first door 101, and one section that extends along the upper side of the second door 102. A similar reinforcement rib 107 may extend along a lower section 109 of the protective cage 100.

A distance D1 between an uppermost edge 108 of the protective cage 100 and the location 35 where the downstream equipment 40 is connected to the conduit 30 may be at least 845 mm. A distance D3 between the inlet 36 of the conduit 30 and the location 35 where the downstream equipment 40 is connected to the conduit 30 may be smaller than 750 mm. The location 35 where the downstream equipment 40 is connected to the conduit 30 may be defined as the location where any moving part of the downstream equipment 40 is positioned. Thus, the distance for D1 and D3 may be determined as the vertical distance between a moving part of the downstream equipment 40 and the uppermost edge 108 of the protective cage 100 respectively the inlet 36 of the conduit 30. The distances D1 and D3 may also be defined as the vertical distance between an outer boundary for the connection between the conduit 30 and the downstream equipment 40, and the uppermost edge 108 of the protective cage 100 respectively the inlet 36 of the conduit 30.

A collar 37 is arranged around the conduit 30, below the inlet 36 as seen in the vertical direction D2, and extends horizontally out from the conduit 30. The collar 37 is positioned above the flexible element 34. The collar 37 does not, as seen in the vertical direction D2, extend below a lowermost edge 1081 of the protective cage 100 by a distance that is larger than 20 mm. This may also apply when the conduit 30, and hence the collar 37, is pushed down to release the bag 90. A maximal distance D2 between an outer periphery of the collar 37 and an inner side of the protective cage 100 is smaller than 125 mm when the protective cage 100 is in the closed position P2.

The downstream equipment 40 is may be supported by the frame structure 10, for example by attaching it to a support bar (not shown) that extends between legs of the frame structure 10. The downstream equipment 40 may also be supported by a structure that rest on the ground.

A magnetic sensor is arranged to provide a signal that indicates if the two doors abut each other at their front edges, which is the case when the protective cage 100 is in the closed position P2. The sensor has a first sensor part 1010 that is mounted on the first door 101, and a second sensor part 1020 that is mounted on the second door 102. These sensor parts 1010, 1020 are arranged to be in contact with each other when the doors 101, 102 abut each other. When the sensor parts 1010, 1020 are in contact with each other the magnetic sensor generates a signal indicative of the protective cage 100 being in the closed position P2. This signal is received by a control unit (not shown) of the system 1. The control unit prevents the downstream equipment 40 from being operated unless a signal indicative of the protective cage 100 being in the closed position P2 has been received. The magnetic sensor, the signal it generates and the control unit may per se be implemented according to known techniques and principles.

The system 1 with the protective cage 100 is advantageous in that it provides efficient protection in form a small structure that allows easy access when, for example, the conduit 30 shall be cleaned. The system 1 may, thanks to the protective cage 100, be operated to discharge the product 92 without requiring any protective grid to be arranged around the system 1, or around the frame structure 10.

From the description above follows that, although various embodiments of the invention have been described and shown, the invention is not restricted thereto, but may also be embodied in other ways within the scope of the subject-matter defined in the following claims.

The invention claimed is:

1. A system for discharging product from a bag, the system comprising a vibration unit arranged to support the bag and to vibrate so that the product exits an opening of the bag, a conduit having an inlet that is located below the vibration unit to receive the product, downstream equipment connected to the conduit to receive the product from the conduit, wherein a protective cage is arranged around the inlet of the conduit, the protective cage having an open position to allow access to the inlet, and a closed position to restrict access to the inlet, the protective cage comprises an upper reinforcement rib that extends along an upper section of the protective cage, protrudes from the upper section, and has a number of through holes that extend along the upper section.

2. The system for discharging product according to claim 1, comprising a frame structure that supports the vibration unit and the conduit, the protective cage being confined within the frame structure when the protective cage is in the closed position.

3. The system for discharging product according to claim 2, wherein the protective cage is confined within the frame structure when the protective cage is in the open position.

4. The system for discharging product according to claim 1, wherein the protective cage comprises two doors that are pivotable about a respective axis and in a direction away from each other.

5. The system for discharging product according to claim 2, wherein the protective cage comprises two doors that are pivotable about a respective axis and in a direction away from each other, and wherein the frame structure comprises two transversal support bars that limit the pivotation of the two doors.

6. The system for discharging product according to claim 1, wherein the conduit comprises a flexible element the is expandable and contractible in a vertical direction, and the protective cage does not extend below any part of the flexible element.

7. The system for discharging product according to claim 4, wherein a number of elongated slots are arranged in the doors such that the conduit is visible through the doors, a width of the slots is smaller than 21 mm, and none of the doors has any opening with a width that is larger than 21 mm.

8. The system for discharging product according to claim 1, wherein a distance between an uppermost edge of the protective cage and the location where the downstream equipment is connected to the conduit is at least 845 mm.

9. The system for discharging product according to claim 1, wherein a distance between the inlet of the conduit and the location where the downstream equipment is connected to the conduit is smaller than 750 mm.

10. The system for discharging product according to claim 1, wherein a collar is arranged around the conduit, below the inlet as seen in a vertical direction.

11. The system for discharging product according to claim 6, wherein a collar is arranged around the conduit, below the inlet as seen in a vertical direction, and wherein the collar does not, as seen in the vertical direction, extend below a lower edge of the protective cage by a distance that is larger than 20 mm.

12. The system for discharging product according to claim 10, wherein a maximal distance between an outer periphery of the collar and an inner side of the protective cage is smaller than 125 mm when the protective cage is in the closed position.

13. A method of operating the system for discharging product according to claim 1, comprising:

supporting the bag with the vibration unit and vibrating the bag so that the product exits the opening of the bag, receiving the product into the conduit having the inlet that is located below the vibration unit, receiving the product from the conduit into the downstream equipment connected to the conduit, wherein the protective cage arranged around the inlet enables the system to be operated such that no protective grid is arranged around the system when the system is operated to discharge the product.

* * * * *